US011375815B1

(12) United States Patent
Barnes

(10) Patent No.: US 11,375,815 B1
(45) Date of Patent: Jul. 5, 2022

(54) SHAMPOO CHAIR FOR USE WITH SINK

(71) Applicant: Candance L. Barnes, Montgomery, AL (US)

(72) Inventor: Candance L. Barnes, Montgomery, AL (US)

( * ) Notice: Subject to any disclaimer, the term of this patent is extended or adjusted under 35 U.S.C. 154(b) by 401 days.

(21) Appl. No.: 16/714,901

(22) Filed: Dec. 16, 2019

(51) Int. Cl.
*A47C 1/06* (2006.01)
*A47C 1/11* (2006.01)
*A47C 1/10* (2006.01)

(52) U.S. Cl.
CPC ..... *A47C 1/06* (2013.01); *A47C 1/11* (2013.01); *A47C 1/10* (2013.01)

(58) Field of Classification Search
CPC .. A47C 1/10; A47C 1/04; A45D 19/08; A45D 19/10; A45D 44/02
See application file for complete search history.

(56) References Cited

U.S. PATENT DOCUMENTS

D134,863 S 1/1943 Nordmark
D171,240 S 12/1953 Wiegel
3,255,344 A 6/1966 Suuronen
3,674,306 A 7/1972 Botney
3,879,085 A * 4/1975 Morel ..... A47C 1/10 312/235.7
3,999,561 A * 12/1976 Gusman ..... A45D 19/08 132/212
4,167,048 A * 9/1979 Williams ..... A45D 44/02 4/519
6,390,550 B1 5/2002 Paredes, Jr. et al.
2008/0229492 A1 9/2008 Jamieson
2012/0096636 A1 4/2012 Gillespie
2021/0145178 A1* 5/2021 Riley ..... A47C 1/06

* cited by examiner

*Primary Examiner* — Sarah B McPartlin
(74) *Attorney, Agent, or Firm* — George L Williamson

(57) ABSTRACT

Method and apparatus for a shampoo chair which reclines and is foldable having an adjustable water catch at the upper end of its back portion for use with a sink while shampooing or dying the hair of a user. The device has a seat portion upon which the user can sit comfortably wherein the back portion is hingedly attached to the seat portion. Legs are provided and attached to the seat portion and are also foldable, along with left and right arm rests so that the user can sit comfortably in the chair portion of the device. The upper end of the back portion is also provided with a U-shaped cutout for receiving the neck of the user wherein the water catch has a mating U-shaped cutout so that when the user reclines in the chair portion of the device the neck of the user is comfortable and the water catch has an upstanding flange on the upper edge of the U-shaped portion which catches all the water and directs it into the sink.

18 Claims, 3 Drawing Sheets

SHAMPOO CHAIR FOR USE WITH SINK

BACKGROUND OF THE INVENTION

Field of the Invention

The present invention relates generally to chairs, and more particularly, is concerned with a foldable chair which is used for shampooing the hair of a user in conjunction with a sink.

Description of the Related Art

Devices relevant to the present invention have been described in the related art; however, none of the related art devices disclose the unique features of the present invention.

In U.S. Pat. No. 3,674,306 dated Jul. 4, 1972, Botney disclosed a compact folding chair. In U.S. Pat. No. Des. 134,863 dated Jan. 26, 1943, Nordmark disclosed a folding chair. In U.S. Pat. No. Des. 171,240 dated Dec. 29, 1953, Wiegel disclosed a folding chair. In U.S. Pat. No. 3,255,344 dated Jun. 7, 1966, Suuronen disclosed a multiple use chair. In U.S. Pat. No. 6,390,550 dated May 21, 2002, Paredes, Jr., et al., disclosed a personal hygiene seat assembly. In U.S. Patent Application Publication No. 2008/0229492 dated Sep. 25, 2008, Jamieson disclosed a reclining, foldable shampoo chair for a bath. In U.S. Patent Application Publication No. 2012/0096636 dated Apr. 26, 2012, Gillespie disclosed a portable shampoo bowl and chair.

While these devices may be suitable for the purposes for which they were designed, they would not be as suitable for the purposes of the present invention as hereinafter described. As will be shown by way of explanation and drawings, the present invention works in a novel manner and differently from the related art.

SUMMARY OF THE PRESENT INVENTION

The present invention discloses a shampoo chair which reclines and is foldable having an adjustable water catch at the upper end of its back portion for use with a sink while shampooing or dying the hair of a user. The present invention has a seat portion upon which the user can sit comfortably wherein the back portion is hingedly attached to the seat portion. Legs are provided and attached to the seat portion and are also foldable, along with left and right arm rests so that the user can sit comfortably in the chair portion of the present invention. The upper end of the back portion is also provided with a U-shaped cutout for receiving the neck of the user wherein the water catch has a mating U-shaped cutout so that when the user reclines in the chair portion of the present invention the neck of the user is comfortable and the water catch has an upstanding flange on the upper edge of the U-shaped portion which catches all the water and directs it into the sink.

An object of the present invention is to provide a portable shampoo chair for use with a sink. A further object of the present invention is to provide a shampoo chair for use with a sink so that all of the water placed on the hair of the user is directed into the sink. A further object of the present invention is to provide a shampoo chair which can be folded for easy storage. A further object of the present invention is to provide a shampoo chair which has a U-shaped cutout at the upper end of its back portion so that the user can recline comfortable in the chair portion of the present invention. A further object of the present invention is to provide a shampoo chair which can be easily operated by a user. A further object of the present invention is to provide a shampoo chair which can be relatively easily and inexpensively manufactured.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
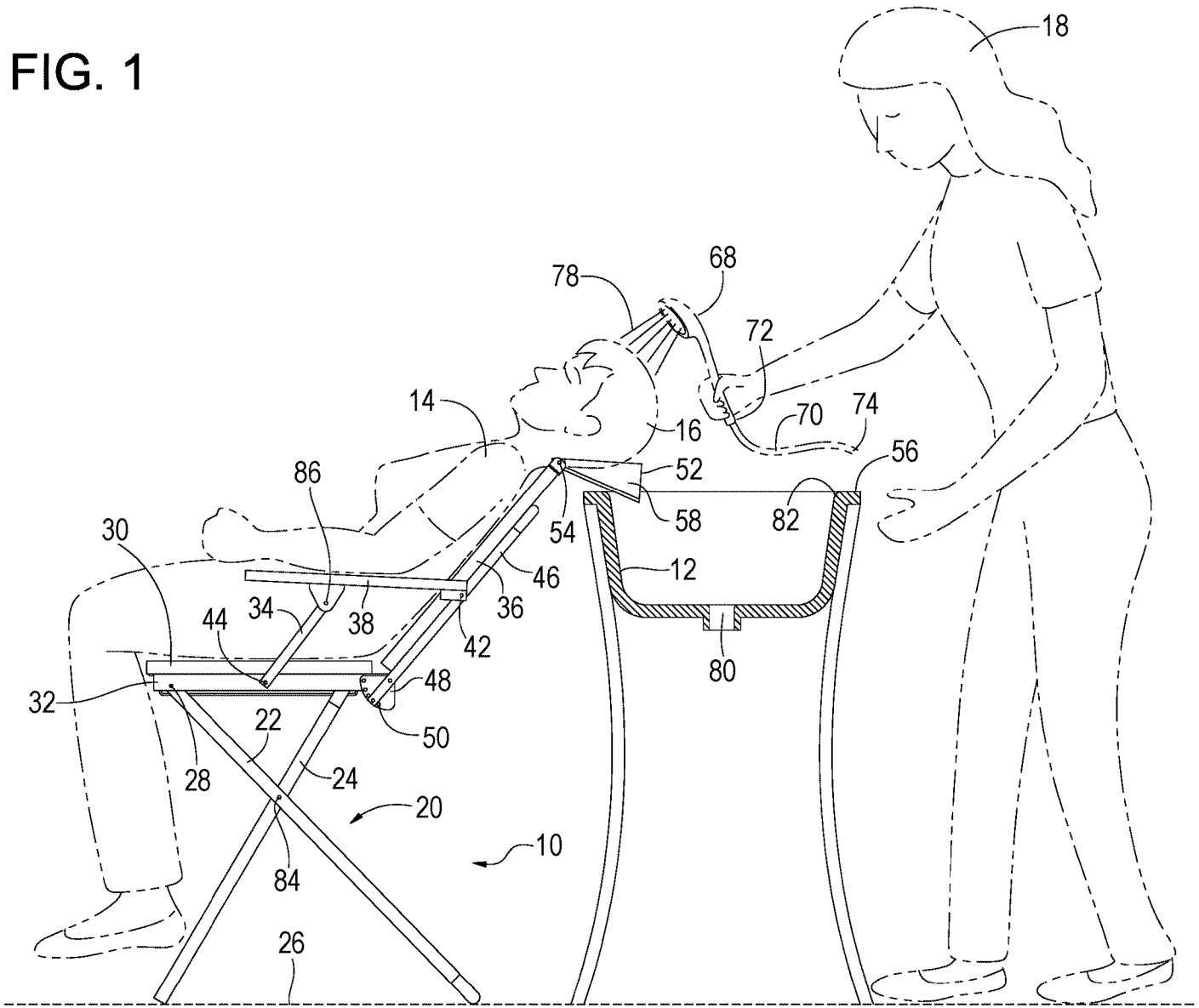
FIG. 1 is a side view of the present invention shown in operative connection with a sink.
Figure 2:
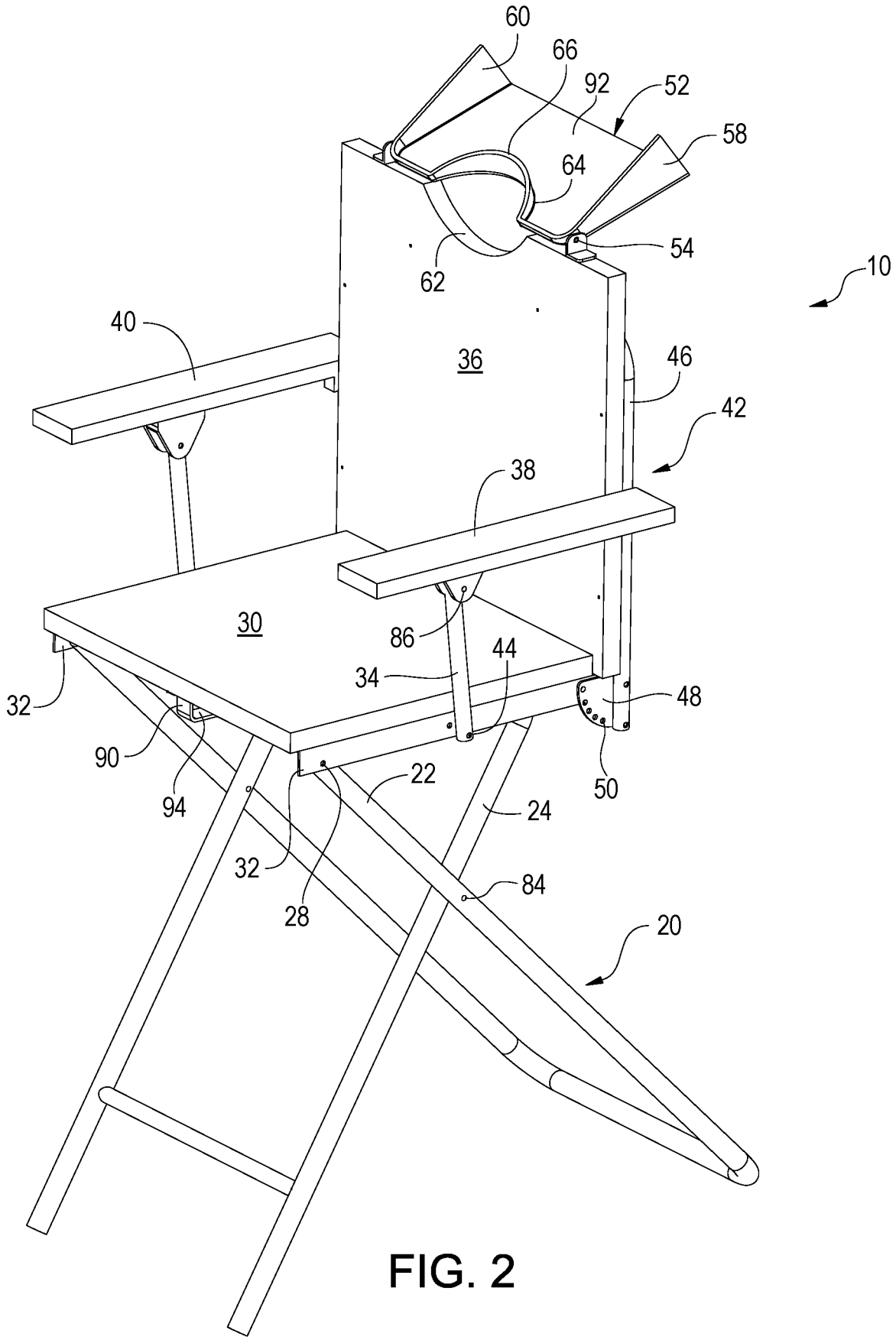
FIG. 2 is a perspective view of the present invention.

With regard to reference numerals used, the following numbering is used throughout the drawings.

10 present invention
12 sink
14 user
16 hair
18 assistant
20 frame
22 front leg frame
24 rear leg frame
26 floor
28 pivot
30 seat portion
32 seat frame support member
34 brace for arm rests
36 back portion
38 left arm rest
40 right arm rest
42 back pivot connection
44 pivot connection
46 back frame portion
48 adjustable bracket
50 notches
52 water catch
54 pivot connection
56 countertop
58 left flange
60 right flange
62 U-shaped cutout
64 U-shaped cutout

66 flange of U-shaped cutout
68 faucet/showerhead apparatus
70 faucet/shower hose
72 first end of faucet/shower hose
74 second end of faucet/shower hose
78 water
80 drain
82 edge of sink drainage bowl
84 pivot connection
86 pivot connection
88 cross member
90 sliding bracket
92 planar portion
94 space

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 6 illustrate the present invention wherein a shampoo chair for use with a sink is disclosed and which is generally indicated by reference number 10.

Turning to FIGS. 1-6, therein is shown the present invention 10 for use with a sink generally shown at 12 wherein a user 14 can shampoo or dye her hair 16 in the comfort of one's own home, e.g., a kitchen. It is understood that an assistant 18 could be available, such as a helper, for giving the user 14 a shampoo or hair dye using the present invention 10. FIG. 1 shows the assistant 18 standing at the head of the user 14 but the assistant could also stand to either side of the user. Also, it should be clear that the present invention 10 is foldable for easy storage as will be illustrated in the drawings as we proceed through the disclosure of this specification.

The present invention 10 includes a support frame 20 which are legs upon which the present invention rests which includes a front leg frame section 22 and a rear leg frame section 24 so that the lower ends of the front and rear frame sections can rest on a supporting surface such as a floor 26 wherein the upper ends of the front and rear leg frame sections are pivotally connected at 28 to the lower sides of the seat portion 30 on the front and rear edges of the seat frame support member 32. A back portion is shown at 36 upon which the back of the user 14 rests along with left and right arm rests 38, 40 which are pivotally joined to the back at 42 and to the seat portion at 44 wherein the pivoted connections are provided so that the chair can be easily folded. A brace 34 for the arm rests is also shown. The back portion 36 is attached to an underlying support frame portion 46 which supports the back portion and which back frame portion is pivotally joined at bracket 48 to a rear edge of the seat portion 30 so that the back portion 36 can be easily adjusted angularly as it moves from a first position to a second position and to other positions wherein the adjustable bracket 48 is provided with multiple stops so that the chair back portion 36 can be frictionally held in its various angular positions relative to the seat portion 30. The adjustable pivoting bracket member 48 is provided with a plurality of notches which frictionally hold the back frame portion 46 in place as it is angularly adjusted. Also shown is a cross member 88 for securing the upper end of legs 24 to the bottom of seat portion 30 along with a sliding bracket 90 with space 94 which surrounds and contains the upper end of legs 24 therein so the leg 24 can slide therein. Also shown is a water catch 52 which is disposed at the upper end of the back portion 36 which water catch is pivotally connected at 54 so that water placed on the hair 16 of the user 14 can be directed into the sink 12 of the countertop 56 of the bathroom or kitchen cabinet or other suitable area that the user 14 chooses to use. The water catch 52 also includes left and right upstanding flange members on its left and right edges 58, 60 which capture and direct all water runoff into the sink 12. Also shown is a U-shaped cutout 62 on the upper end of the back portion 36 wherein the water catch 52 has a mating U-shaped cutout 64 built into its mating edge which also includes an upwardly standing flange 66 which prevents water from escaping and directs the water into the sink 12 as the user or assistant 18 sprays water onto the hair 16 of the user. The assistant 18 is shown holding a faucet/shower head apparatus 68 which includes a flexible conduit or hose 70 which has a first end 72 and a second end 74 which would be connected to a water faucet or like water source (not shown) of the sink 12 as would be done in the standard manner by one skilled in the art.

Figure 3:
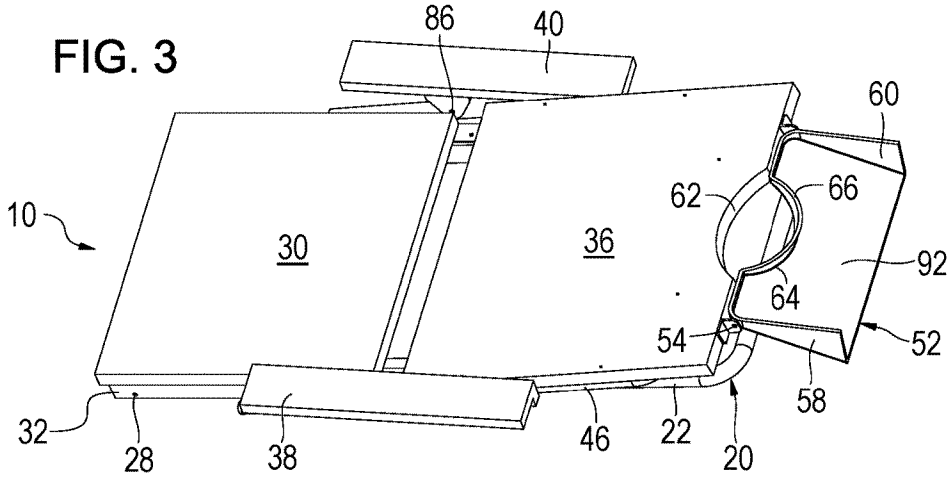
FIG. 3 is a perspective view of the present invention in the folded position.
Figure 4:
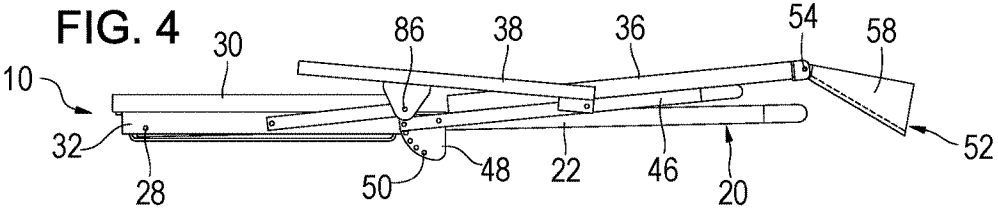
FIG. 4 is a side view of the present invention in the folded position.

Turning to FIGS. 3-4, therein is shown the present invention 10 in the folded position. Previously disclosed elements are also shown. Also shown in FIG. 3 are the U-shaped cutout 62 of the back portion 36 along with its mating U-shaped cutout 64 of the water catch 52 along with the flange 66 of the U-shaped cutout on the water catch.

Figure 5:
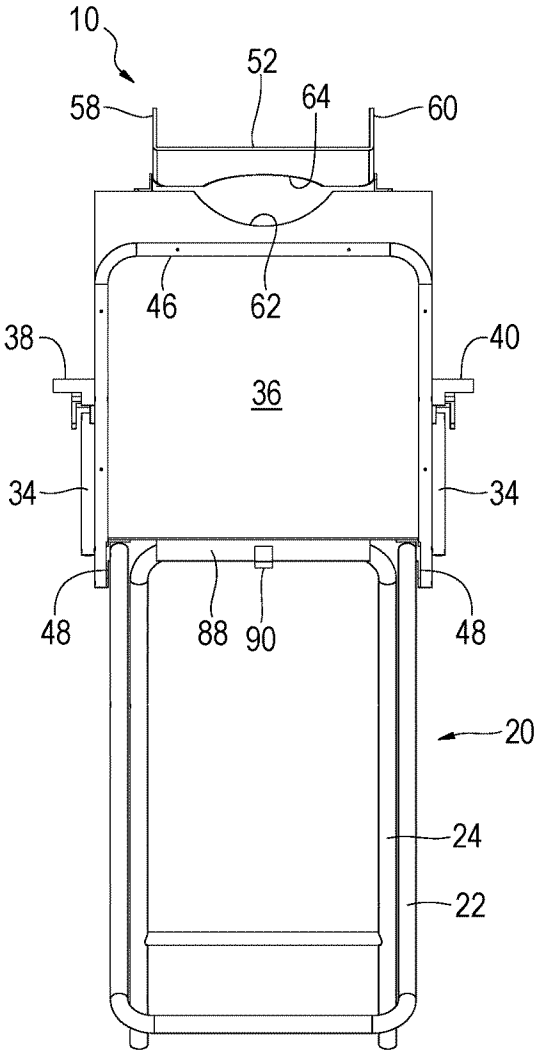
FIG. 5 is a rear view of the present invention.

Turning to FIG. 5, therein is shown the rear side view of the present invention 10. Previously disclosed elements are also shown including the back frame portion 46 upon which the back portion 36 is mounted. Also shown are the U-shaped cutout 62 of the back portion 36 along with its mating U-shaped cutout 64 of the water catch 52.

Figure 6:
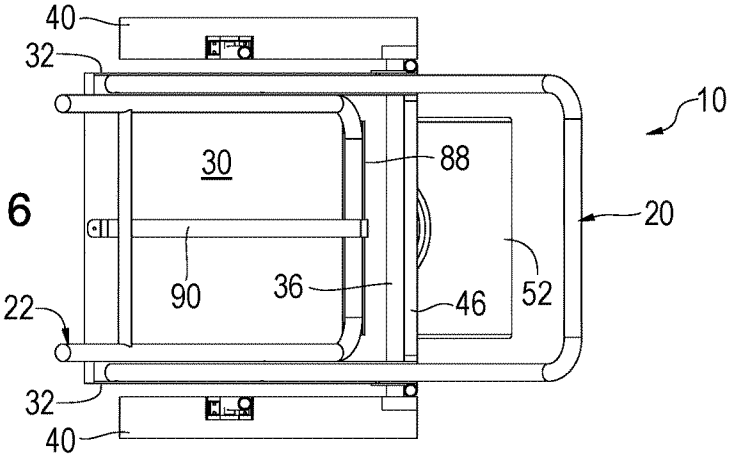
FIG. 6 is a bottom view of the present invention.

Turning to FIG. 6, therein is shown a bottom view of the present invention 10 showing the bottom of the seat portion 30 having a cross member 88 for securing the upper end of legs 24 to the bottom of seat portion 30 along with a sliding bracket 90 with space 94 surrounds and contains the upper end of legs 24 therein thereby allowing the upper end of legs 24 to slid therein to the front and rear so that the legs can be easily moved into and out of the folded position as shown in FIGS. 3-4.

In operation, the user 14 would place the present invention 10 in the user's kitchen, bathroom or other suitable area in close proximity to a sink 12 so that the user 14 or assistant 18 could shampoo the hair 16 of the user 14 as the hair is placed into the sink 12 wherein water 78 from the faucet/shower head apparatus 68 would be directed onto the hair 16 of the user 14 and then onto the water catch 52 and thereafter into the drain 80 of the sink 12 so that the water 78 is hygienically and safely removed down the drain 80 of the sink 12 as would be done in the standard manner. The user 14 could adjust the present invention 10 so that the back portion 36 was at a comfortable angle relative to the sink 12 and the neck of the user 14 could rest comfortably in the U-shaped cutout 62 of the chair and the U-shaped cutout 66 of the water catch 52 so that the neck of the user 14 would be comfortable during the shampooing experience.

Left and right side designations regarding the present invention 10 as shown in FIG. 1 are interpreted from the view of one seated in the seat portion 30 and facing in the direction of the front of the chair, i.e., toward his/her feet; the rear of the present invention 10 would be in the direction of the back 36. Also, lines with arrowheads are sometimes placed on drawings to indicate potential motion or direction of movement of an item illustrated in the drawing.

In way of summary and by reference to FIGS. 1-6, the present invention shows a shampoo chair 10 for use with a sink 12 for shampooing hair 16 of a user 14, including a seat member 30 upon which the user can sit with a back member 36 joined to a rear end of the seat member and extending upwardly therefrom for supporting a back of the user; a plurality of legs 22, 24 for supporting the seat member with a water catch 52 pivotally connected to an upper end of the back member, the water catch having a planar portion 92 having left 58 and right 60 upwardly extending flanges thereon, wherein the left flange is disposed on a left edge of the water catch and the right flange is disposed on a right edge of the water catch for channeling water into the sink; a first U-shaped cutout 62 disposed on the upper end of the back member for receiving a neck of the user; a second U-shaped cutout 64 disposed in the planar portion of the water catch for receiving the neck of the user, wherein the second U-shaped cutout is proximate to the first U-shaped cutout, wherein the second U-shaped cutout is pivotal at 54 along with the water catch relative to the first U-shaped cutout, providing a third upwardly extending flange 66 disposed along the second U-shaped cutout for channeling water into the sink; and wherein the first and second U-shaped cutout each have an open end, wherein each open end faces each other for receiving the neck of the user therein.

Also shown is a left and a right seat frame support member 32, wherein the seat member is joined to the left and right seat frame support member, wherein the seat member is fixedly connected to the left and right seat frame support member with a back frame member 46, wherein the back member is attached to the back frame member, wherein the back frame member is pivotally joined at 48 to the rear end of the seat member wherein the back frame member is angularly adjustable at 50 in a range of about 0 degrees to about 90 degrees with respect to a horizontal plane with a front leg member 22 having an upper end pivotally connected to the seat frame support member and a lower end for resting upon a support surface and a rear leg member 24 having an upper end movably connected to a lower surface of the seat member and a lower end for resting upon a support surface; further, a left and a right arm rest 38, 40 wherein a rear end of each left and right arm rests are pivotally joined to the back frame member, further comprising a brace 34 for each of the left and right arm rest pivotally connected to the seat frame support member.

I claim:

1. A shampoo chair for use with a sink for shampooing hair of a user, comprising:

a) a seat member upon which the user can sit, a back member joined to a rear and of said seat member and extending upwardly therefrom for supporting a back of the user;

b) a plurality of legs for supporting said seat member;

c) a water catch pivotally connected to an upper end of said back member, said water catch having a planar portion having left and right upwardly extending flanges thereon, wherein said left flange is disposed on a left edge of said water catch and said right flange is disposed on a right edge of said water catch for channeling water into the sink;

d) a first U-shaped cutout disposed on said upper end of said back member for receiving a neck of the user;

e) a second U-shaped cutout disposed in said planar portion of said water catch for receiving the neck of the user, wherein said second U-shaped cutout is proximate to said first U-shaped cutout, wherein said second U-shaped cutout is pivotal along with said water catch relative to said first U-shaped cutout, a third upwardly extending flange disposed along said second U-shaped cutout for channeling water into the sink; and f) wherein said first and second U-shaped cutout each have an open end, wherein each said open end faces each other for receiving the neck of the user therein.

2. The shampoo chair of claim 1, further comprising a left and a right seat frame support member, wherein said seat member rests on said left and right seat frame support member, wherein said seat member is fixedly connected to said left and right seat frame support member.

3. The shampoo chair of claim 2, further comprising a back frame member, wherein said back member is attached to said back frame member, wherein said back frame member is pivotally joined to said rear end of said seat member.

4. The shampoo chair of claim 3, wherein said back frame member is angularly adjustable in a range of about 0 degrees to about 90 degrees with respect to a horizontal plane.

5. The shampoo chair of claim 4, further comprising a front leg member having an upper and pivotally connected to said seat frame support member and a lower end for resting upon a support surface.

6. The shampoo chair of claim 5, further comprising a rear leg member having an upper end movably connected to a lower surface of said seat member and a lower end for resting upon a support surface.

7. The shampoo chair of claim 6, further comprising a left and a right arm rest.

8. The shampoo chair of claim 7, wherein a rear end of each said left and right arm rests are pivotally joined to said back frame member, further comprising a brace for each said left and right arm rest pivotally connected to said seat frame support member.

9. The shampoo chair of claim 8, wherein the shampoo chair is foldable into a storage position.

10. A method of making a shampoo chair for use with a sink for shampooing hair of a user, comprising the steps of:

a) providing a sat member upon which the user can sit, providing a back member joined to a rear end of the seat member and extending upwardly therefrom for supporting a beck of the user;

b) providing a plurality of lop for supporting the seat member;

c) providing a water catch pivotally connected to an upper end of the back member, the water catch having a planar portion having left and right upwardly extending flanges thereon, wherein the left flange is disposed on a left edge of the water catch and the right flange is disposed on a right edge of the water catch for channeling water into the sink;

d) providing a first U-shaped cutout disposed on the upper end of the back member for receiving a neck of the user;

e) providing a second U-shaped cutout disposed in the planar portion of the water catch for receiving the neck of the user, wherein the second U-shaped cutout is proximate to the first U-shaped cutout, wherein the second U-shaped cutout is pivotal along with the water catch relative to the first U-shaped cutout, providing a third upwardly extending flange disposed along the second U-shaped cutout for channeling water into the sink; and f) wherein the first and second U-shaped cutout each have an open end, wherein each open end faces each other for receiving the neck of the user therein.

11. The method of claim 10, further comprising the step of providing a left and a right seat frame support member, wherein the seat member rests on the left and right seat frame support member, wherein the seat member is fixedly connected to the left and right sent frame support member.

12. The method of claim 11, further comprising the step of providing a back frame member, wherein the back member is attached to the back frame member, wherein the back frame member is pivotally joined to the rear end of the seat member.

13. The method of claim 12, wherein the back frame member is angularly adjustable in a range of about 0 degrees to about 90 degrees with respect to a horizontal plane.

14. The method of claim 13, further comprising the step of providing a front leg member having an upper end pivotally connected to the seat frame support member and a lower end for resting upon a support surface.

15. The method of claim 14, further comprising the step of providing a rear leg member having an upper end movably connected to a lower surface of the seat member and a lower end for resting upon a support surface.

16. The method of claim 15, further comprising the step of providing a left and a right arm rest.

17. The method of claim 16, wherein a rear end of each left and right arm rests are pivotally joined to the back frame member, further comprising a brace for each of the left and right arm rest pivotally connected to the seat frame support member.

18. The method of claim 17, wherein the shampoo chair is foldable into a storage position.

* * * * *